United States Patent [19]

Walker

[11] Patent Number: 4,809,630

[45] Date of Patent: Mar. 7, 1989

[54] VIEW PORT FOR AN UNDERWATER VEHICLE

[75] Inventor: Terence D. Walker, Penrhyndeudraeth, Wales

[73] Assignee: Hydrovision Limited, Aberdeen, Scotland

[21] Appl. No.: 31,007

[22] PCT Filed: Jul. 23, 1986

[86] PCT No.: PCT/GB86/00440

§ 371 Date: May 4, 1987

§ 102(e) Date: May 4, 1987

[87] PCT Pub. No.: WO87/00501

PCT Pub. Date: Jan. 29, 1987

[30] Foreign Application Priority Data

Jul. 23, 1985 [GB] United Kingdom ..... 8518642

[51] Int. Cl.[4] ..... B63C 11/00

[52] U.S. Cl. ..... 114/66; 114/312; 114/315

[58] Field of Search ..... 114/66, 312, 313, 315; 441/135, 78; 352/131, 132; 354/64, 76

[56] References Cited

U.S. PATENT DOCUMENTS

| | | | |
|---|---|---|---|
| 3,450,082 | 6/1969 | Demarest | 114/312 |
| 3,633,370 | 1/1972 | McKinley | 114/315 |
| 3,635,183 | 1/1972 | Keatinge | 114/312 |
| 3,750,547 | 8/1973 | Walthier et al. | 354/64 |
| 3,757,725 | 9/1973 | Horn | 114/312 |
| 3,774,564 | 11/1973 | Bondon et al. | 114/312 |
| 3,779,201 | 12/1973 | Spahn | 441/78 |
| 3,839,109 | 10/1974 | Horn | 156/3 |
| 4,063,258 | 12/1977 | Allen | 352/132 |

FOREIGN PATENT DOCUMENTS

| | | |
|---|---|---|
| 1517551 | 2/1968 | France . |
| 2541229 | 8/1984 | France . |

*Primary Examiner*—Sherman D. Basinger
*Assistant Examiner*—Stephen P. Avila
*Attorney, Agent, or Firm*—Gordon L. Peterson

[57] ABSTRACT

View port for an underwater vehicle, e.g. for a remotely operated vehicle (ROV) usable for underwater inspection, and provides a view port (2) which can form a component of a pressure hull of an underwater vehicle, and which can be sandwiched between hull portions (4) to provide a transparent section girdling the hull. Preferably, the view port can form a component of a substantially spherical pressure hull, the view port being sandwiched between two similar part-spherical hull portions. The invention further provides an underwater vehicle having a view port which forms a component of a pressure hull and which provides a transparent section girdling the hull. A camera (10) may be pivotally mounted in the hull so as to allow rotation of the camera to view through the port. A light source may be provided in the hull and arranged so as to allow light from the light source to be shone out through the view port. The view port may be an integral ring of transparent material and the view port may provide a field of view over a full 360°.

20 Claims, 2 Drawing Sheets

VIEW PORT FOR AN UNDERWATER VEHICLE

Figure 1:
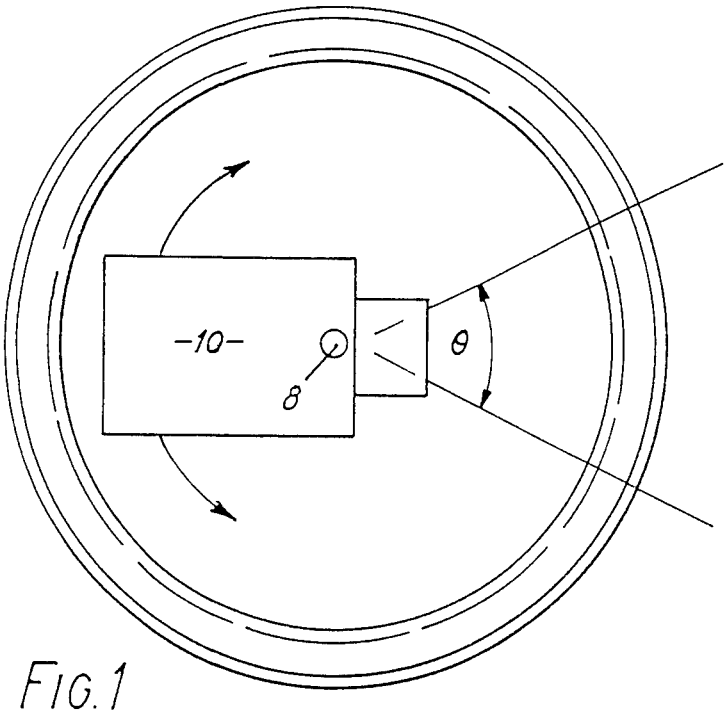

The present invention relates to a view port, and particularly to a view port for an underwater vehicle, e.g. for a remotely operated vehicle (ROV) usable for underwater inspection.

Early ROVs for underwater inspection had pressure-sealed and water-proofed cameras mounted externally of the ROV pressure hull. Such cameras were liable to both leakage and collision damage. More recently, ROVs have had cameras sealed behind optically transparent view ports. Such view ports have been made of materials such as acrylic and glass and have been fitted to ROV pressure hulls with suitable seals. Generally, a flat plate view port has been used where the the ROV has a forward looking camera and a hemispherical port has been used where the camera is required to pan and tilt. With conventional hemispherical view ports the pan and tilt angles are limited to approximately 70°.

The present invention provides a view port which can form a component of a pressure hull of an underwater vehicle, and which can be sandwiched between hull ports to provide a transparent section girdling the hull. Preferably, the view port can form a component of a substantially spherical pressure hull, the view port being sandwiched between two similar part-spherical hull ports. The invention further provides an underwater vehicle having a view port which forms a component of a pressure hull and which provides a transparent section girdling the hull.

In an underwater vehicle having a view port according to the invention, a camera may be pivotally mounted in the hull so as to allow rotation of the camera to view through the port. A light source may be provided in the hull and arranged so as to allow light from the light source to be shone out through the view port.

As a further aspect of the invention, an underwater vehicle could be provided with a hull extension comprising a view port sandwiched between hull portions to provide a transparent section girdling the hull extension.

In an underwater vehicle, it is a particular advantage of the invention that the joint faces between the view port and the hull sections are bevelled in order that external pressure may assist in sealing the joints.

The view port can provide a field of view over a full 360°. When the view port forms part of a substantially spherical pressure hull it is a particular advantage that the view is not distorted by the port (i.e. the port is optically correct) because the view at any angle from the centre of the sphere is through a view port section which forms an arc.

Preferably, an underwater vehicle may have a view port according to the invention which is an integral ring of transparent material, but it is conceivable that the port could be discontinuous. Whilst it is a feature of the invention that a view port can provide a 360° field of view, in some instances parts of the view port may be obstructed, or parts may even be absent, so that the field of view is substantially but not completely all the way around the hull.

Figure 2:
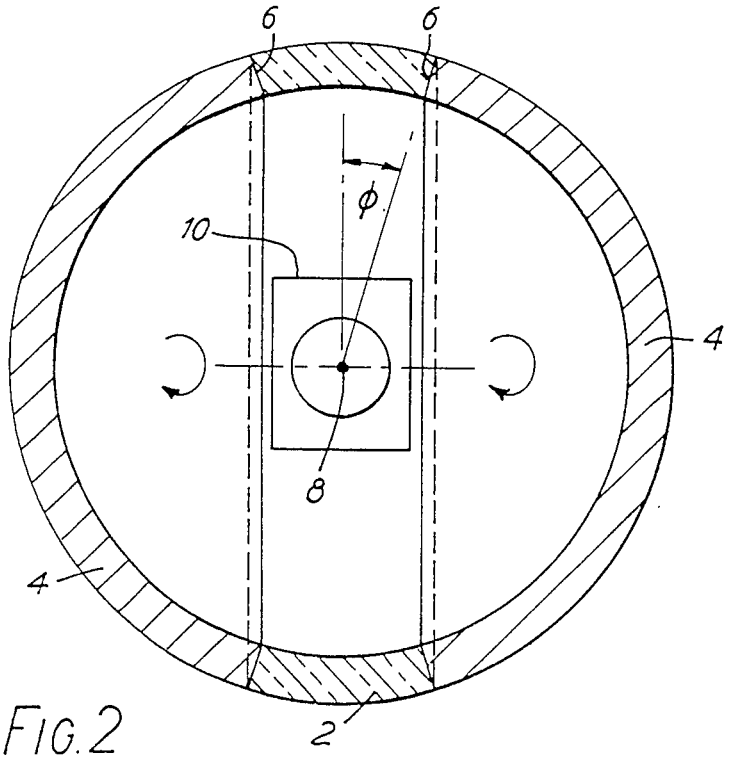
Figure 3:
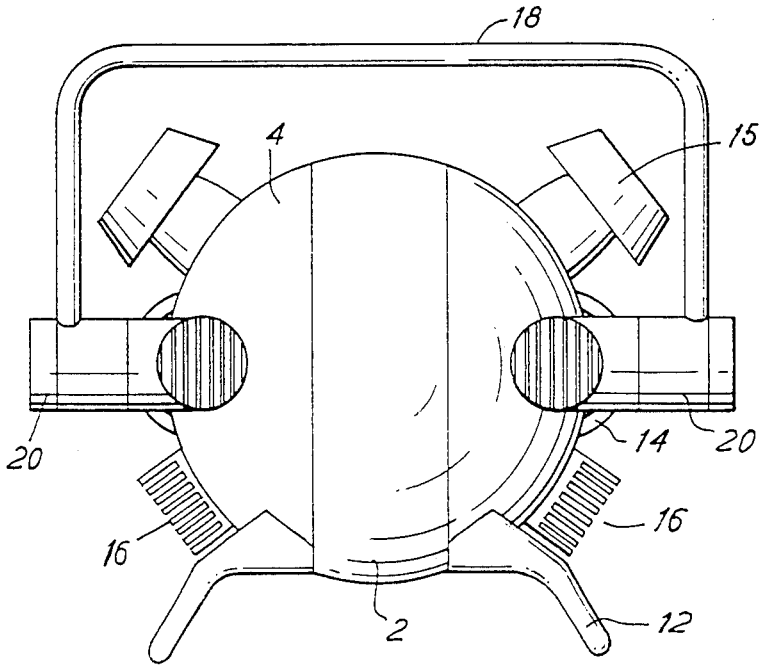
Figure 4:
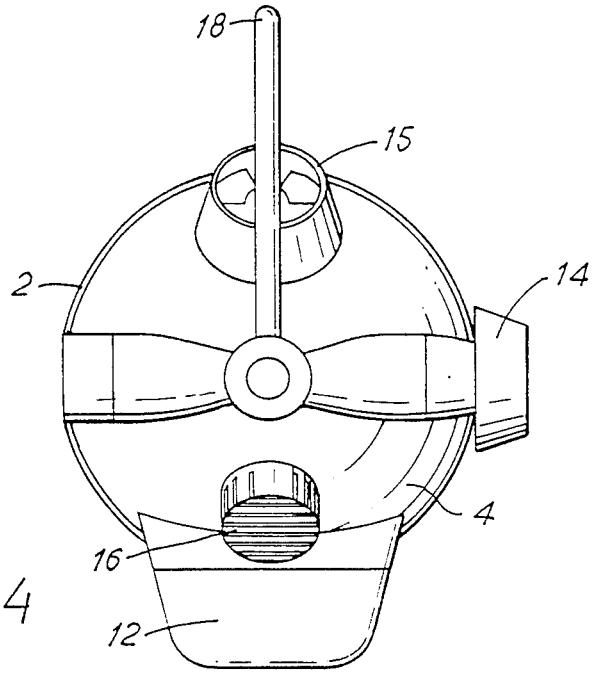

The invention will now be described in detail, by way of example only, with reference to the accompanying drawings in which :

FIGS. 1 and 2 are schematic sectional drawings of an underwater vehicle incorporating a view port according to the invention; and FIGS. 3 and 4 are front and side elevations of a spherical ROV incorporating a view port according to the invention.

As shown in FIGS. 1 and 2, an underwater vehicle has an equatorial view port 2 made from transparent acrylic plastics material. The view port 2 is sandwiched between two part-spherical hull sections 4. The thickness of the port and the hull sections is chosen to be sufficient to withstand the external pressures which will be encountered under water at the operational depth range of the vehicle.

The joint faces 6 of the port and hull sections 4 are angled (bevelled) radially towards the centre 8 of the hull. External pressure on the hull sections and port will tend to press the joint faces 6 together and so assist in sealing of the joints.

In this embodiment a video camera 10 is mounted at the centre 8, and is pivoted so as to allow rotation of the camera to view through the port through a full 360°. As the camera 10 is rotated about the centre 8, the field of view scans equatorially. With the view port in a vertical orientation this arrangement allows the camera 10 to inspect an area in front, behind, above and below the vehicle. Whilst the use of a video camera is presently preferred for inspection, it is to be understood that other cameras (e.g. still, movie) could be used, or that other imaging devices or other suitable remote sensors could be used.

Furthermore, the viewport of the invention could be used in an underwater vehicle having inside the pressure hull a light source arranged to allow light to be shone out through the view port. This allows, for example, for light from the light source to be directed to specifically illuminate a particular area which is to be inspected. Clearly, both inspection (e.g. by camera) and illumination could be carried out simultaneously by an underwater vehicle, e.g. an ROV, having a view port according to the invention.

As shown in the embodiment of FIGS. 3 and 4 the hull sections 4 of an ROV have stabilizer fins 12 and thrusters 14, 15 powered by electric motors. The thrusters 14 allow forward and backward maneouvring and the thrusters 15 control upward and downward movement in the water. The control circuitry and motors necessary for operating a camera and for controlling ROV positioning are all preferably contained within the sealed hull. In use, heat generated within the ROV is dissipated to the surrounding water via heat sinks 16.

Generally the ROV will be tethered to a top-side command centre by a control cable. The ROV is provided with a lifting handle 18 pivotted about bearings 20. The handle 18 may be used to tow the vehicle from the centre of gravity of the ROV.

I claim:

1. An underwater vehicle having a view port which forms a component of a substantially spherical pressure hull and which is sandwiched between hull portions to provide a transparent section girdling the hull, wherein the view port is an equatorial ring of transparent material providing through the ring from the centre of the hull a field of view in an equatorial plane of substantially 360 degrees whereby a view which is substantially undistorted by the view port is provided.

2. A vehicle according to claim 1 having a camera pivotally mounted in the hull so as to allow rotation of the camera to view through the view port.

3. A vehicle according to claim 1 having a light source in the hull and arranged so as to allow light from the light source to be shone out through the view port.

4. A vehicle according to claim 2 having a light source in the hull and arranged so as to allow light from the light source to be shone out through the view port.

5. A vehicle according to claim 1 wherein the joint faces between the view port and the hull portions are bevelled in order that external pressure may assist in sealing the joints between the view port and hull portions.

6. A vehicle according to claim 2 wherein the joint faces between the view port and the hull portions are bevelled in order that external pressure may assist in sealing the joints between the view port and hull portions.

7. A vehicle according to claim 3 wherein the joint faces between the view port and the hull portions are bevelled in order that external pressure may assist in sealing the joints between the view port and hull portions.

8. A vehicle according to claim 4 wherein the joint faces between the view port and the hull portions are bevelled in order that external pressure may assist in sealing the joints between the view port and hull portions.

9. A vehicle According to claim 1 wherein the view port is an integral ring of transparent material.

10. A vehicle According to claim 2 wherein the view port is an integral ring of transparent material.

11. A vehicle According to claim 3 wherein the view port is an integral ring of transparent material.

12. A vehicle According to claim 4 wherein the view port is an integral ring of transparent material.

13. A vehicle According to claim 5 wherein the view port is an integral ring of transparent material.

14. A vehicle According to claim 6 wherein the view port is an integral ring of transparent material.

15. A vehicle According to claim 7 wherein the view port is an integral ring of transparent material.

16. A vehicle According to claim 8 wherein the view port is an integral ring of transparent material.

17. A vehicle according to claim 1 which is a remotely operated vehicle (ROV) usable for underwater inspection.

18. An underwater vehicle comprising a substantially spherical pressure hull including first and second part-spherical hull portions and a part-spherical view port of transparent material, said view port being between the hull portions and forming an equatorial ring of the substantially spherical hull to provide a substantially 360-degree view from the center of the hull in an equatorial plane whereby a view which is substantially undistorted by the view port is provided.

19. A vehicle as defined in claim 18 wherein said view port and the first and second hull portions have confronting joint faces which are bevelled so that external pressure acting on the view port will tend to press the joint faces together to assist in sealing between the view port and the first and second hull portions.

20. A vehicle as defined in claim 18 wherein each of said first and second hull sections is contiguous the view port.

* * * * *